US008377540B2

(12) United States Patent
Chiu et al.

(10) Patent No.: US 8,377,540 B2
(45) Date of Patent: Feb. 19, 2013

(54) TRANSFER FILM, METHOD OF MANUFACTURING THE SAME, TRANSFER METHOD AND OBJECT SURFACE STRUCTURE

(75) Inventors: Ju-Chen Chiu, Taipei (TW); Yin Ta Chen, Taipei (TW)

(73) Assignee: Compal Electronics, Inc., Taipei (TW)

( * ) Notice: Subject to any disclaimer, the term of this patent is extended or adjusted under 35 U.S.C. 154(b) by 544 days.

(21) Appl. No.: 12/581,895

(22) Filed: Oct. 20, 2009

(65) Prior Publication Data

US 2010/0104807 A1 Apr. 29, 2010

Related U.S. Application Data

(60) Provisional application No. 61/108,012, filed on Oct. 23, 2008.

(51) Int. Cl.
*B41B 3/00* (2006.01)

(52) U.S. Cl. ..... 428/161; 428/163; 428/166; 428/167; 428/200; 428/343; 428/344; 428/352; 428/354; 428/913; 428/913.3; 428/914

(58) Field of Classification Search ..... 428/161, 428/163, 166, 167, 200, 343, 344, 352, 354, 428/913, 913.3, 914
See application file for complete search history.

(56) References Cited

U.S. PATENT DOCUMENTS

2008/0286500 A1* 11/2008 Sussner et al. ..... 428/13
2010/0151207 A1* 6/2010 Hansen et al. ..... 428/172

FOREIGN PATENT DOCUMENTS

TW 200604765 2/2006
TW 200804439 1/2008
WO WO 2006/108611 A2 * 10/2006

OTHER PUBLICATIONS

"Office Action of Taiwan Counterpart Application", issued on Oct. 26, 2011, p. 1-p. 4.

* cited by examiner

*Primary Examiner* — Betelhem Shewareged
(74) *Attorney, Agent, or Firm* — Jianq Chyun IP Office

(57) ABSTRACT

A transfer film including a protection layer and a substrate is provided. The substrate has a first surface with a first three-dimensional pattern and a second surface. The first three-dimensional pattern has at least one protrusion portion or at least one recess portion. The protection layer is disposed on the substrate and has a third surface and a fourth surface. The third surface contacts the first surface and has a second three-dimensional pattern complementary to the first three-dimensional pattern. The second three-dimensional pattern of the third surface is formed by covering the first three-dimensional pattern of the first surface. The protection layer and the substrate are separated after transfer, so as to expose the second three-dimensional pattern.

9 Claims, 9 Drawing Sheets

TRANSFER FILM, METHOD OF MANUFACTURING THE SAME, TRANSFER METHOD AND OBJECT SURFACE STRUCTURE

CROSS-REFERENCE TO RELATED APPLICATION

This application claims the priority benefit of U.S. provisional application Ser. No. 61/108,012, filed on Oct. 23, 2008. The entirety of the above-mentioned patent application is hereby incorporated by reference herein and made a part of this specification.

BACKGROUND

1. Technical Field

The present invention generally relates to a transfer film, a method of manufacturing the same, a transfer method and a three-dimensional (3D) structure. More particularly, the present invention relates to a transfer film having a substrate with a three-dimensional pattern, a method of manufacturing the same, a transfer method and a three-dimensional structure.

2. Description of Related Art

Nowadays, thermal transfer technology is widely applied to fabrication process of goods, such as patterns or labels. Thermal transfer film is frequently utilized in the thermal transfer technology so as to thermal transfer an ink layer on a surface of products. After the thermal transfer, since the ink layer thermally transferred on the products directly contacts with the external environment, the ink layer is prone to be damaged, e.g. scratched. Accordingly, it is needed to manually spray-coat a protection layer on the ink layer, so as to protect the ink layer. The step of manually spray-coating the protection layer, however, raises the labor cost and the fabrication time, and causes the surface of the products with three-dimensional pattern (e.g. the surface of the products provided with the ink layer with the three-dimensional pattern) to be planarized, thereby disadvantageous to a development of the thermal transfer technology.

FIG. 1 is a cross-sectional view schematically illustrating a product utilizing a conventional thermal transfer technology. As shown in FIG. 1, the step of manually spray-coating a protection layer 110 enables the protection layer 110 to fill up a three-dimensional pattern 122 of an ink layer 120. A surface 112 of a product 100 is therefore turned into almost a plane after spray coating the protection layer 110, such that the surface 112 of the product 100 loses a tactile perception of three-dimensional pattern 122 of the ink layer 120.

SUMMARY

Accordingly, the present invention is directed to a transfer film including a substrate and a protection layer, wherein the protection layer covers a three-dimensional pattern of the substrate.

The present invention is directed to a method of manufacturing the transfer film, so as to fabricate the protection layer with the three-dimensional pattern.

The present invention is directed to a transfer method, so as to transfer the protection layer with the three-dimensional pattern onto an acceptor.

The present invention is directed to an object surface structure, of which the protection layer has the three-dimensional pattern.

The transfer film of the present invention is provided, which includes a substrate and a protection layer. The substrate has a first surface with a first three-dimensional pattern and a second surface. The first three-dimensional pattern has at least one first protrusion portion or at least one first recess portion. The protection layer is disposed on the substrate and has a third surface and a fourth surface. The third surface contacts the first surface and has a second three-dimensional pattern complementary to the first three-dimensional pattern. The second three-dimensional pattern is formed by the third surface covering over the first three-dimensional pattern of the first surface. The protection layer and the substrate are separated after a transfer, so as to expose the second three-dimensional pattern.

According to an embodiment of the present invention, the substrate includes a submount and a pattern layer which are shaped individually. The pattern layer disposed on the submount and covered with the protection layer has the first three-dimensional pattern.

According to an embodiment of the present invention, the protection layer includes a thermal curing resin, a radiation curing resin and an electron beam curing resin.

According to an embodiment of the present invention, the transfer film further includes a release coating disposed between the substrate and the protection layer.

According to an embodiment of the present invention, the transfer film further includes a decorative layer disposed on the protection layer.

According to an embodiment of the present invention, the decorative layer includes an ink layer or a metallic plating layer or a non-metallic coating layer.

According to an embodiment of the present invention, the transfer film further includes an adhesive layer disposed on the protection layer.

According to an embodiment of the present invention, the substrate includes a resin film, a metal film or a paper film.

According to an embodiment of the present invention, the transfer film is suitable for thermal transfer technology.

According to an embodiment of the present invention, the second surface and the fourth surface are of planar structures.

The method for manufacturing the transfer film of the present invention is described as follows. A substrate having a first three-dimensional pattern is provided, wherein the first three-dimensional pattern has at least one protrusion portion or at least one recess portion. A protection layer is coated on the substrate to cover the first three-dimensional pattern, such that a second three-dimensional pattern complementary to the first three-dimensional pattern is formed on a surface of the protection layer which covers the first three-dimensional pattern. The protection layer and the substrate are separated after a transfer so as to expose the second three-dimensional pattern.

According to an embodiment of the present invention, the step of providing the substrate includes providing a submount, and forming a pattern layer on the submount, wherein the pattern layer has the first three-dimensional pattern.

According to an embodiment of the present invention, the step of forming the pattern layer includes processing a surface of the substrate so as to form the first three-dimensional pattern.

According to an embodiment of the present invention, the step of processing the surface of the substrate includes rubbing.

According to an embodiment of the present invention, the step of forming the pattern layer includes printing or bonding.

According to an embodiment of the present invention, the step of forming the pattern layer includes forming a covering layer on the submount, and processing the covering layer so as to form the first three-dimensional pattern.

According to an embodiment of the present invention, the step of processing the covering layer includes imprinting or rubbing.

According to an embodiment of the present invention, the method for manufacturing the transfer film further includes coating a release coating on the substrate before forming the protection layer, wherein the protection layer is formed on the release coating.

According to an embodiment of the present invention, the method for manufacturing the transfer film further includes forming a decorative layer on the protection layer after forming the protection layer.

According to an embodiment of the present invention, the decorative layer includes an ink layer or a metallic plating layer or a non-metallic coating layer.

According to an embodiment of the present invention, the method for manufacturing the transfer film further includes forming an adhesive layer on the protection layer.

According to an embodiment of the present invention, the transfer film is suitable for thermal transfer technology.

The transfer method of the present invention is described as follows. A transfer film is provided, which includes a substrate and a protection layer. The substrate has a first three-dimensional pattern, wherein the first three-dimensional pattern has at least one protrusion portion or at least one recess portion. The protection layer is disposed on the substrate, such that a second three-dimensional pattern complementary to the first three-dimensional pattern is formed by the protection layer covering over the first three-dimensional pattern. Afterwards, the transfer film is disposed on an acceptor, wherein the protection layer is deployed between the substrate and the acceptor. The substrate of the transfer film is then heated or pressurized, such that the protective layer adheres to the acceptor. Thereafter, the substrate is lifted off, so as to expose a structure of the second three-dimensional pattern.

According to an embodiment of the present invention, the transfer film further includes a release coating disposed between the substrate and the protection layer.

According to an embodiment of the present invention, when the substrate is lifted off, the transfer method further includes lifting the release coating off.

According to an embodiment of the present invention, the transfer film further includes a decorative layer disposed on the protection layer, and the decorative layer is deployed between the protection layer and the acceptor when disposing the transfer film on the acceptor.

According to an embodiment of the present invention, the decorative layer includes an ink layer or a metallic plating layer or a non-metallic coating layer.

According to an embodiment of the present invention, the transfer film further includes an adhesive layer disposed on the protection layer, and the transfer film adheres to the acceptor through the adhesive layer when disposing the transfer film on the acceptor.

According to an embodiment of the present invention, the transfer method further includes pressurizing the substrate when the substrate of the transfer film is heated, such that the protection layer and the acceptor are bonded tightly.

The object surface structure of the present invention is provided, which includes an object and a protection layer. The protection layer is disposed on the object by a transfer technology and has an exposed surface and a three-dimensional pattern deployed on the exposed surface. The three-dimensional pattern has at least one protrusion portion or at least one recess portion. The three-dimensional pattern is formed by the protection layer covering over a first three-dimensional pattern of a substrate before the transfer.

According to an embodiment of the present invention, the transfer technology includes lifting the substrate with the first three-dimensional pattern off, so as to present the exposed surface of the protection layer with the three-dimensional pattern.

According to an embodiment of the present invention, the transfer technology is thermal transfer technology.

According to an embodiment of the present invention, the object surface structure further includes a decorative layer disposed between the protection layer and the object.

According to an embodiment of the present invention, the object surface structure further includes an adhesive layer disposed between the protection layer and the object.

As mentioned above, the present invention proposes that the substrate of the transfer film has the three-dimensional pattern, and thereby the protection layer formed on the substrate has the three-dimensional pattern as well. After the transfer, the protection layer with the three-dimensional pattern is thus formed on a surface of a finished product. Accordingly, the exterior surface of the finished product which is transferred by the transfer film of the present invention can be provided with an obvious tactile perception of the three-dimensional pattern.

In order to make the aforementioned and other features and advantages of the present invention more comprehensible, preferred embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
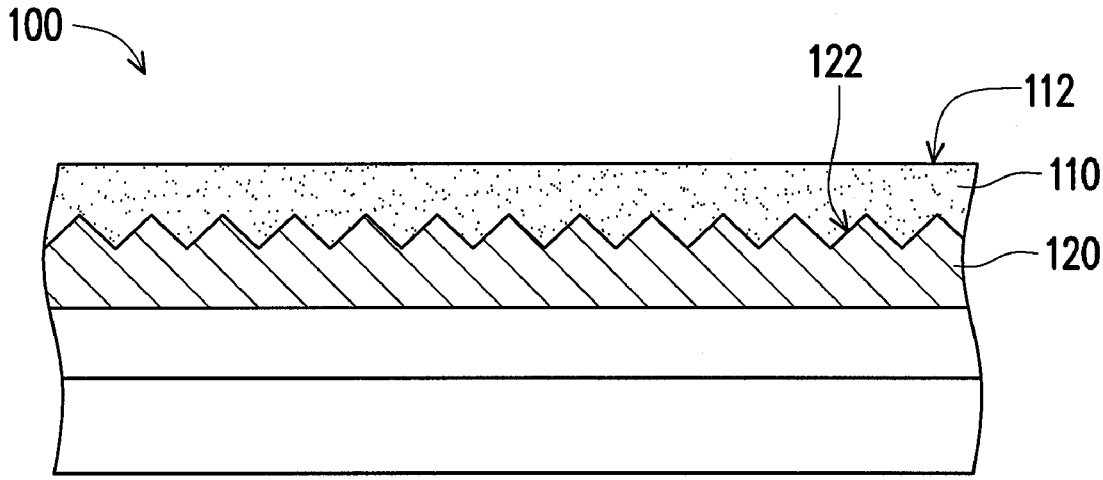
FIG. 1 (RELATED ART)
FIG. 1 is a cross-sectional view schematically illustrating a product utilizing a conventional thermal transfer technology.

Reference will now be made in detail to the present preferred embodiments of the invention, examples of which are illustrated in the accompanying drawings. Wherever possible, the same reference numbers are used in the drawings and the description to refer to the same or like parts.

The thermal transfer film and the thermal transfer technology are provided as an exemplary example for illustrating the features in this invention, and should not be adopted for limiting the present invention.

Figure 2A:
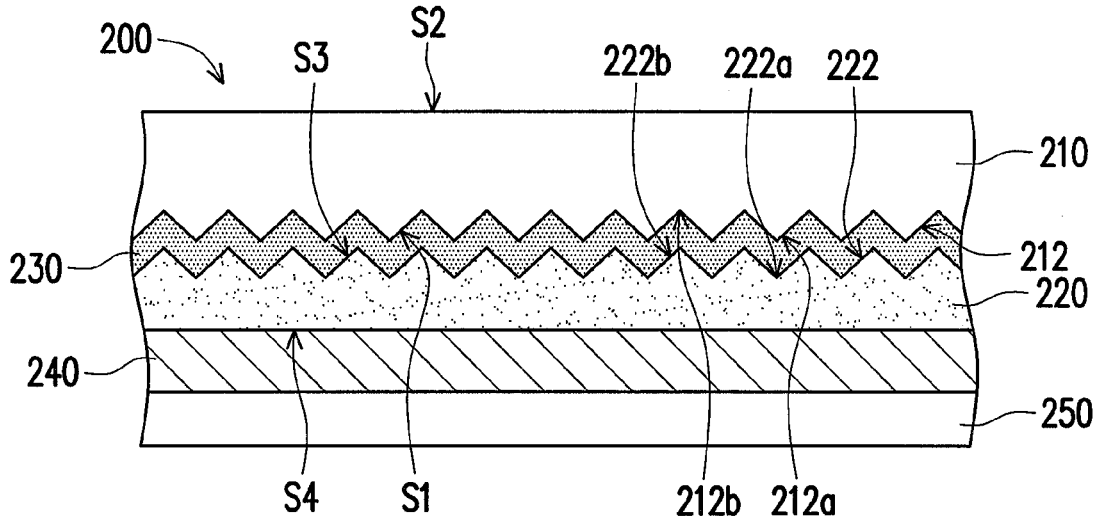
FIG. 2A depicts schematically, in a cross-sectional view, the thermal transfer film according to an embodiment of the present invention.
Figure 2B:
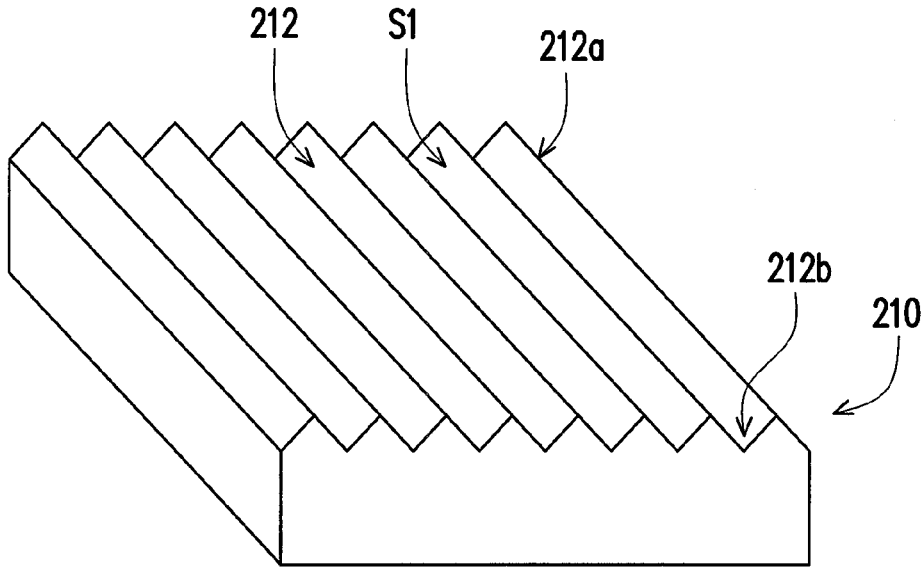
FIG. 2B is a schematic diagram illustrating the substrate shown in FIG. 2A.
Figure 3:
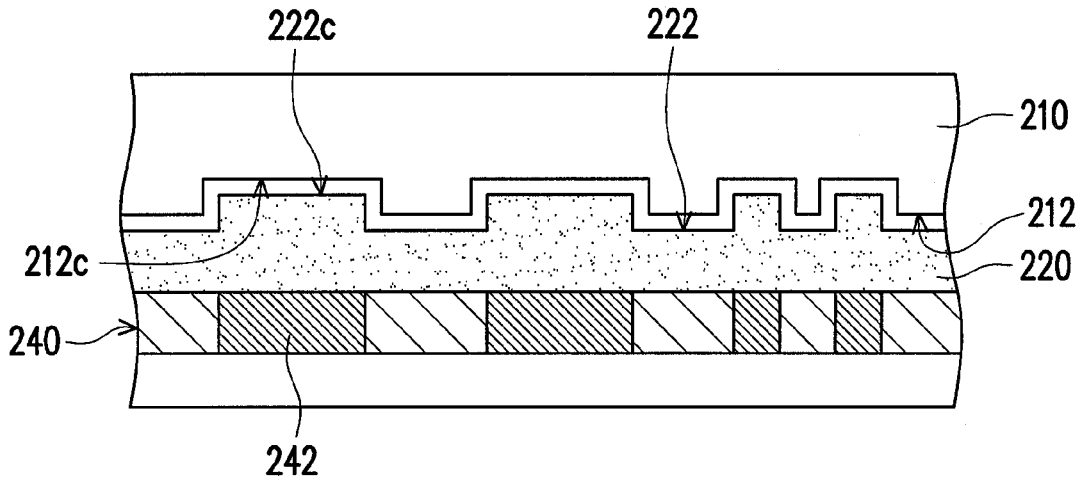
FIG. 3 depicts schematically, in a cross-sectional view, the thermal transfer film according to another embodiment of the present invention.
Figure 4:
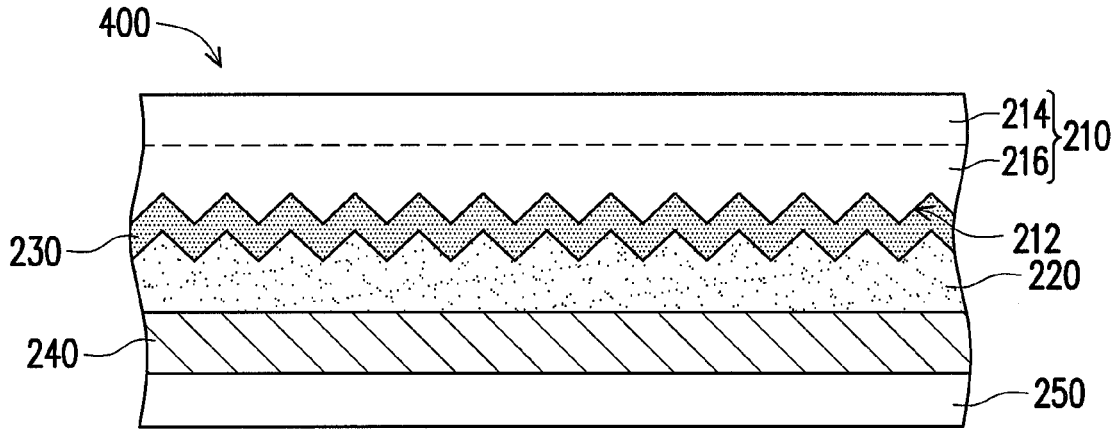
FIG. 4 depicts schematically, in a cross-sectional view, the thermal transfer film according to still another embodiment of the present invention.

FIG. 2A depicts schematically, in a cross-sectional view, the thermal transfer film according to an embodiment of the present invention, and FIG. 2B is a schematic diagram illustrating the substrate shown in FIG. 2A. FIG. 3 depicts schematically, in a cross-sectional view, the thermal transfer film according to another embodiment of the present invention. FIG. 4 depicts schematically, in a cross-sectional view, the thermal transfer film according to still another embodiment of the present invention.

Referring to FIGS. 2A and 2B, a thermal transfer film 200 of the present embodiment includes a substrate 210 and a protection layer 220. The substrate 210 has a first surface S1 and a second surface S2, and the first surface S1 has a first three-dimensional pattern 212. The first three-dimensional pattern 212 can be a texture with a specific tactile perception, such as a brushed filament texture, a texture with particular pattern (e.g. flowers or the like decorative patterns), etc. In detail, the first three-dimensional pattern 212 has at least one protrusion portion 212*a* or at least one recess portion 212*b*. In other words, the first three-dimensional pattern 212 is substantially a three-dimensional structure with a jog tactile perception (or a rough tactile perception).

The protection layer 220 is disposed on the substrate 210 and covers the first three-dimensional pattern 212, and the protection layer 220 has a third surface S3 and a fourth surface S4. The third surface S3 contacts the first surface S1, and has a second three-dimensional pattern 222 complementary to the first three-dimensional pattern 212. The second three-dimensional pattern 222 is formed by the third surface S3 covering over the first three-dimensional pattern 212 of the first surface S1. The protection layer 220 and the substrate 210 are separated after the transfer, such that the second three-dimensional pattern 222 is exposed. To be more specific, the second three-dimensional pattern 222 can be a three-dimensional structure with a jog tactile perception, and the second three-dimensional pattern 222 is structurally complementary to the first three-dimensional pattern 212. For example, the protrusion portion 212*a* of the first three-dimensional pattern 212 is in conformity with the recess portion 222*a* of the second three-dimensional pattern 222, and the recess portion 212*b* of the first three-dimensional pattern 212 is in conformity with the protrusion portion 222*b* of the second three-dimensional pattern 222. In addition, in the present embodiment, the second surface S2 and the fourth surface S4 are of planar structures.

In the present embodiment, the material of the protection layer 220 includes thermal curing resin, radiation curing resin or electron beam curing resin. The foregoing thermal curing resin can be acrylic-based resin, acrylic polyol based resin, vinyl-based resin, polyester-based resin, epoxy-based resin, or polyurethane-based resin. The foregoing radiation curing resin and electron beam curing resin each includes monomer and oligomer. The monomer may be monofunctional, bifunctional or multiple functional methacrylate-based group, acrylate-based group, vinyl-based group, vinyl-ether based group, and epoxy-based group. The oligomer may be unsaturated polyester-based group, epoxy acrylate-based group, polyurethane acrylate-based group, polyester acrylate-based group, polyether acrylate-based group, acrylated acrylic oligomer group, and epoxy-based resin.

Moreover, a release coating 230 can be disposed between the substrate 210 and the protection layer 220 in order to facilitate lifting off the substrate 210 after the thermal transfer process. Additionally, in the present embodiment, a decorative layer 240 can be disposed on the protection layer 220, so as to decorate the appearance of the finished product after the thermal transfer. The decorative layer 240 is, for example, an ink layer, or a metallic plating layer, or a non-metallic coating layer, or a material layer with decorative effects or purposes. The material of the metallic plating layer can be Au, Ag, Cu, Al, Zn, Sn, Si, Ti, or other suitable metals. The material of the non-metallic coating layer can be ceramics, inorganic powder, or other suitable non-metal.

Referring to FIG. 3, in other embodiments, when the decorative layer 240 has a pattern 242 (e.g. a pattern composed of various colors), the first three-dimensional pattern 212 of the substrate 210 can optionally correspond to the pattern 242 of the decorative layer 240. For instance, the portion of the first three-dimensional pattern 212 of the substrate 210 opposite to the pattern 242 is a recess 212*c*, while the portion of the second three-dimensional pattern 222 of the protection layer 220 opposite to the pattern 242 is a protrusion 222*c*. The pattern 242 of the decorative layer 240 can present a stereoscopic impression after the thermal transfer by means of the protrusion 222*c*.

In the same way, in other embodiments, the portion of the first three-dimensional pattern 212 of the substrate 210 opposite to the pattern 242 may be a protrusion (not shown), while the portion of the second three-dimensional pattern 222 of the protection layer 220 opposite to the pattern 242 may be a recess.

Besides, referring to FIG. 2 again, in the present embodiment, an adhesive layer 250 can be disposed on the protection layer 220, in order to enhance adhesion of the thermal transfer film 200. The adhesive layer 250 is, for example, made up by a resin material, which can be acrylic-based resin, urethane-based resin, vinyl-based resin, polyester-based resin, polystyrene-based resin, polypropylene-based resin, polyethylene-based resin, or polycarbonate-based resin.

Furthermore, referring to FIG. 4, the substrate 210 of the thermal transfer film 400 can include a submount 214 and a pattern layer 216, wherein the submount 214 and the pattern layer 216 can be formed integrally (the same material) or formed individually (the same material or different materials). The pattern layer 216 is disposed on the submount 214. The pattern layer 216 has the first three-dimensional pattern 212, and the protection layer 220 covers the pattern layer 216. In detail, the protection layer 220 covers the first three-dimensional pattern 212.

In the present embodiment, the submount 214 and the pattern layer 216 can be respectively made by a metal material, a resin material, a cellulosic material, or other suitable materials. The foregoing metal material is, for example, Al or Cu. The foregoing resin material is, for example, acrylic resin, polyester, polystyrene (PS), polypropylene (PP), polyvinyl chloride (PVC), polyethylene (PE), polycarbonate (PC), or polyurethane (PU). The foregoing cellulosic material is, for example, paper. The substrate 210, for example, ranges in thickness from 1.0 μm to 4 mm.

Figure 5A:
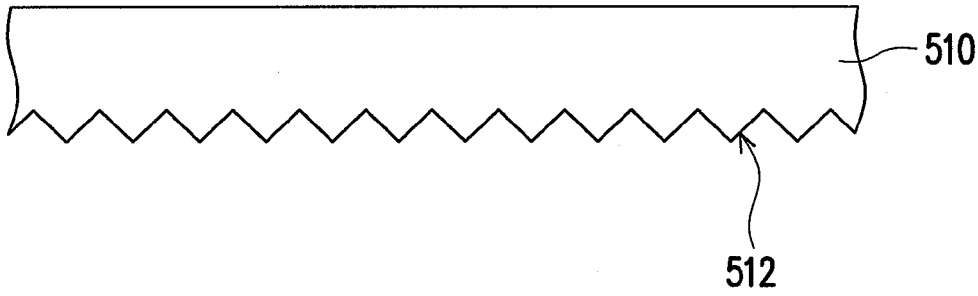
FIGS. 5A-5C are cross-sectional diagrams schematically illustrating a process for fabricating the thermal transfer film according to an embodiment of the present invention.
Figure 5B:
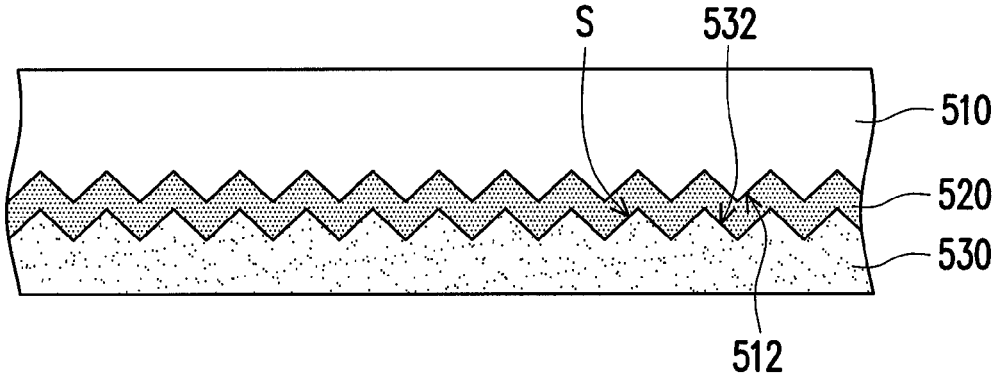
Figure 5C:
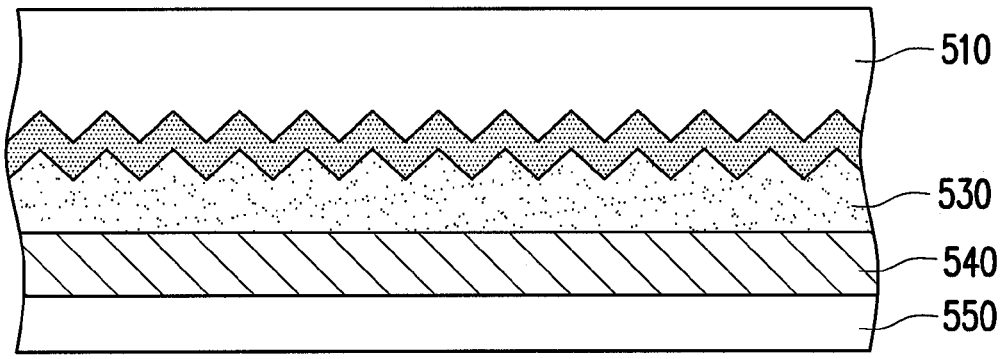

A manufacturing method of the thermal transfer film 200 is then elaborated in FIGS. 5A-5C. Two manufacturing methods of the thermal transfer film 400 are elaborated in FIGS. 6A-6B and FIGS. 7A-7C as follows.

FIGS. 5A-5C are cross-sectional diagrams schematically illustrating a process for fabricating the thermal transfer film according to an embodiment of the present invention. It is noted that the identical elements shown in FIGS. 5A-5C and the thermal transfer film 200 shown in FIG. 2 are designated with the same reference numbers, and detailed descriptions (e.g. materials) of the same or like elements are omitted hereinafter.

Referring to FIG. 5A, a submount (no shown) is provided. The surface of the submount is then processed to form a first three-dimensional pattern 512, such that a substrate 510 with the first three-dimensional pattern is formed. In the present embodiment, methods for processing the surface of the submount include physical processing such as rubbing, chemical processing such as etching, or other processing which can be applied to damage the surface of the submount.

Next, referring to FIG. 5B, a release coating 520 can be optionally coated on the substrate 510. A protection layer 530 is then coated on the release coating 520. The protection layer 530 covers the first three-dimensional pattern 512, and a second three-dimensional pattern 532 complementary to the first three-dimensional pattern 512 is formed on the surface S of the protection layer 530 which covers the first three-dimensional pattern 512. In detail, the second three-dimensional pattern 532 structurally corresponds to the first three-dimensional pattern 512. The protection layer 530 and the substrate 510 can be separated after the transfer, so as to exposed the second three-dimensional pattern 532. In the present embodiment, formation of the protection layer 530 can be carried out by coating a resin layer on the substrate 510 by scraper coating, but is not intended to limit the scope of this invention. That is to say, formation of the protection layer 530 can be carried out by other manners.

Afterwards, referring to FIG. 5C, a decorative layer 540 can be optionally formed on the protection layer 530. In the present embodiment, the decorative layer 540 can be an ink layer, or a metallic plating layer, or a non-metallic coating layer, or a material layer with decorative effects or purposes. The metallic plating layer can be fabricated by a chemical plating method, e.g. electroless plating, or by a physical plating method, e.g. sputtering. The ink layer can be fabricated by ink jetting or printing. In other embodiments, formation of the decorative layer 540 may be carried out by other suitable manners. Alternatively, an adhesive layer 550 is then formed on the decorative layer 540, so as to enhance the adhesion of the thermal transfer film.

Figure 6A:
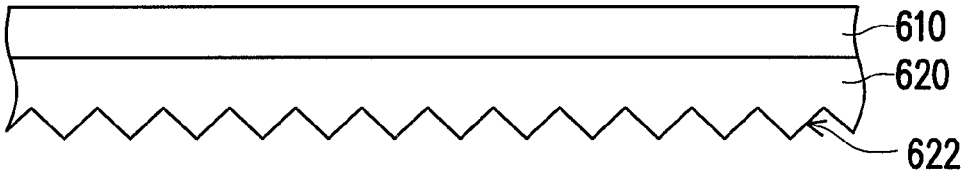
FIGS. 6A-6B are cross-sectional diagrams schematically illustrating a process for fabricating the thermal transfer film according to another embodiment of the present invention.
Figure 6B:
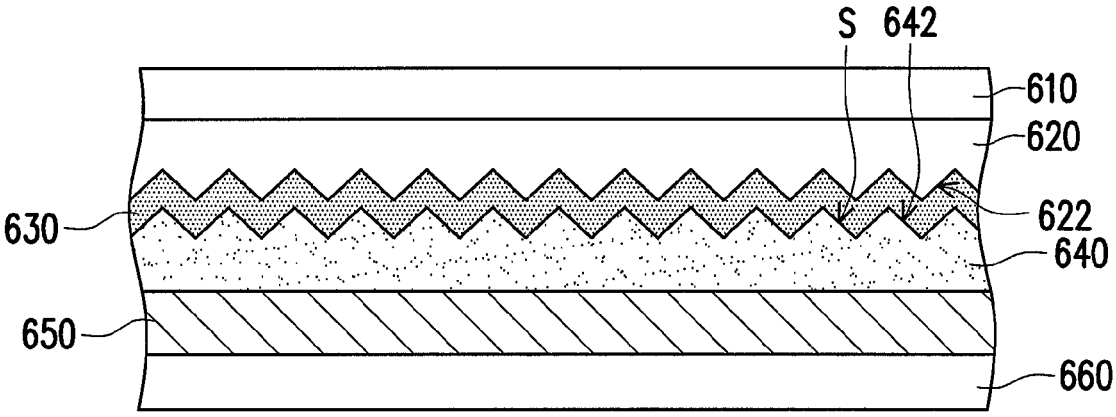

FIGS. 6A-6B are cross-sectional diagrams schematically illustrating a process for fabricating the thermal transfer film according to another embodiment of the present invention. It is noted that the identical elements shown in FIGS. 6A-6B and the thermal transfer film 400 shown in FIG. 4 are designated with the same reference numbers, and detailed descriptions (e.g. materials) of the same or like elements are omitted hereinafter.

Referring to FIG. 6A, a submount 610 is provided. A pattern layer 620 is formed on the submount 610, wherein the pattern layer 620 has a first three-dimensional pattern 622 so as to achieve a substrate with the first three-dimensional pattern. In the present embodiment, formation of the pattern layer 620 includes printing a film directly on the submount 610, or bonding a film on the submount 610, or other suitable methods.

Referring to FIG. 6B, a release coating 630 is coated on the pattern layer 620. A protection layer 640 is then coated on the release coating 630. The protection layer 640 covers the first three-dimensional pattern 622, and a second three-dimensional pattern 642 complementary to the first three-dimensional pattern 622 is formed on the surface S of the protection layer 640 which covers the first three-dimensional pattern 622. In the present embodiment, the protection layer 640 can be separated from the substrate 610 and the pattern layer 620 after the transfer, such that the second three-dimensional pattern 642 is exposed. In the present embodiment, formation of the protection layer 640 includes coating a resin layer on the submount 610 by scraper coating.

Afterwards, in the present embodiment, a decorative layer 650 is optionally formed on the protection layer 640. In the present embodiment, the decorative layer 650 can be an ink layer, or a metallic plating layer, or a non-metallic coating layer. The metallic plating layer can be fabricated by a chemical plating method or a physical plating method. The ink layer can be fabricated by ink jetting or printing. Then, an adhesive layer 660 is formed on the decorative layer 650 optionally.

Figure 7A:
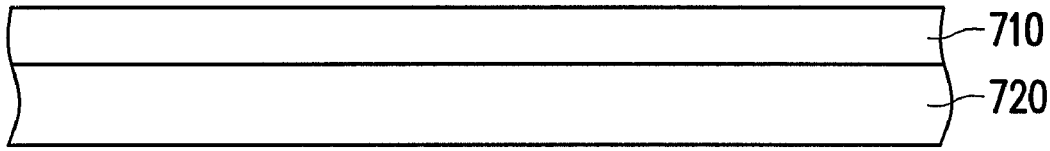
FIGS. 7A-7C are cross-sectional diagrams schematically illustrating a process for fabricating the thermal transfer film according to still another embodiment of the present invention.
Figure 7B:
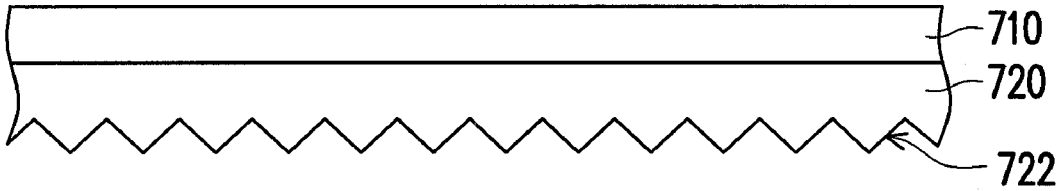
Figure 7C:
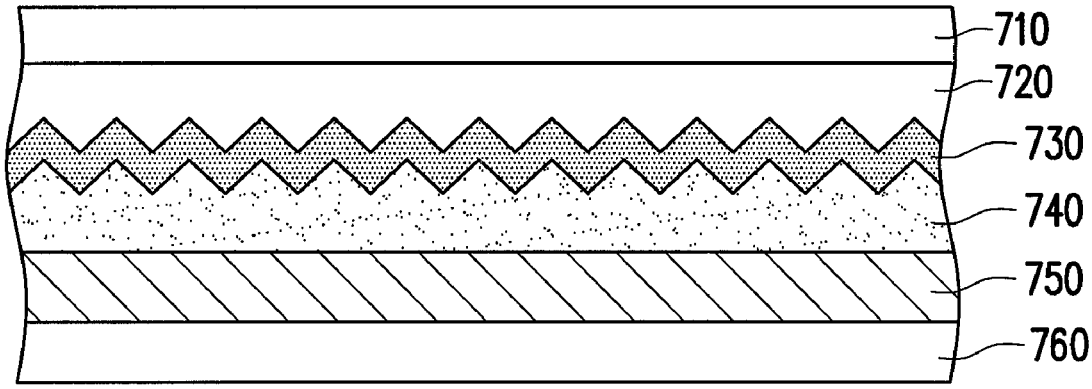

FIGS. 7A-7C are cross-sectional diagrams schematically illustrating a process for fabricating the thermal transfer film according to still another embodiment of the present invention. It is noted that the identical elements shown in FIGS. 7A-7C and the thermal transfer film 400 shown in FIG. 4 are designated with the same reference numbers, and detailed descriptions (e.g. materials) of the same or like elements are omitted hereinafter.

Referring to FIG. 7A, a submount 710 is provided. A covering layer 720 is then formed on the submount 710 by coating. The covering layer 720 is, for example, made up by resin or other materials prone to processing and shaping.

Referring to FIG. 7B, the covering layer 720 is, for example, processed by imprinting or rubbing, so as to form a first three-dimensional pattern 722 and thus to achieve a substrate with the first three-dimensional pattern. Afterwards, referring to FIG. 7C, as similar to the process illustrated in FIG. 6B, a release coating 730, a protection layer 740, a decorative layer 750 and an adhesive layer 760 are formed in sequence on the covering layer 720.

Figure 8A:
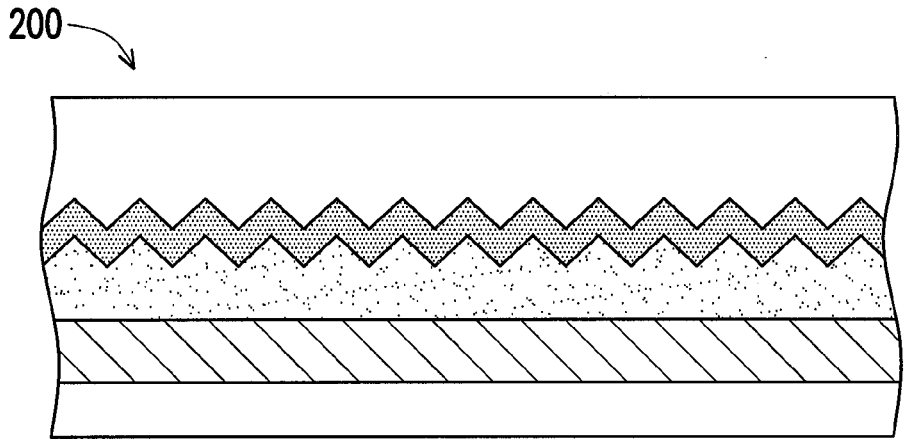
FIGS. 8A-8C are cross-sectional diagrams schematically illustrating a thermal transfer process according to an embodiment of the present invention.
Figure 8B:
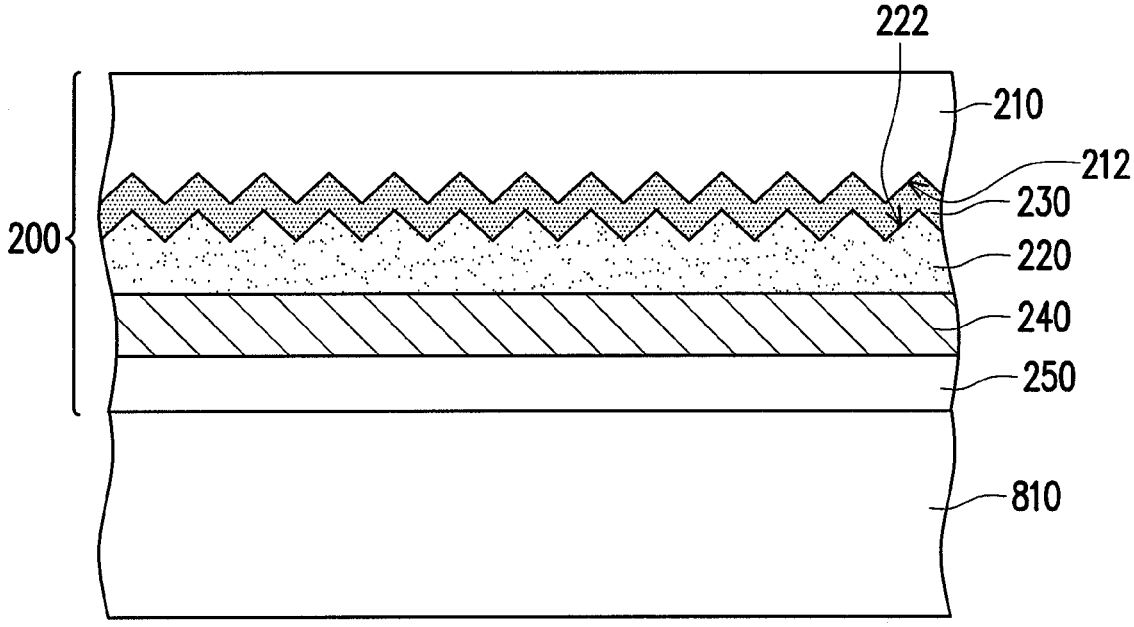
Figure 8C:
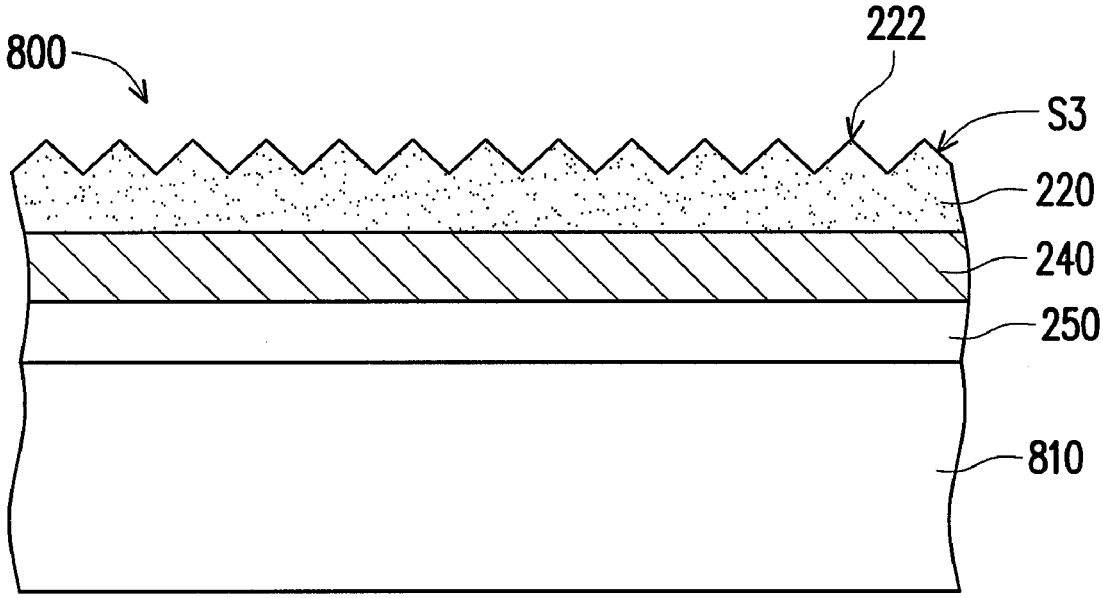
Figure 9:
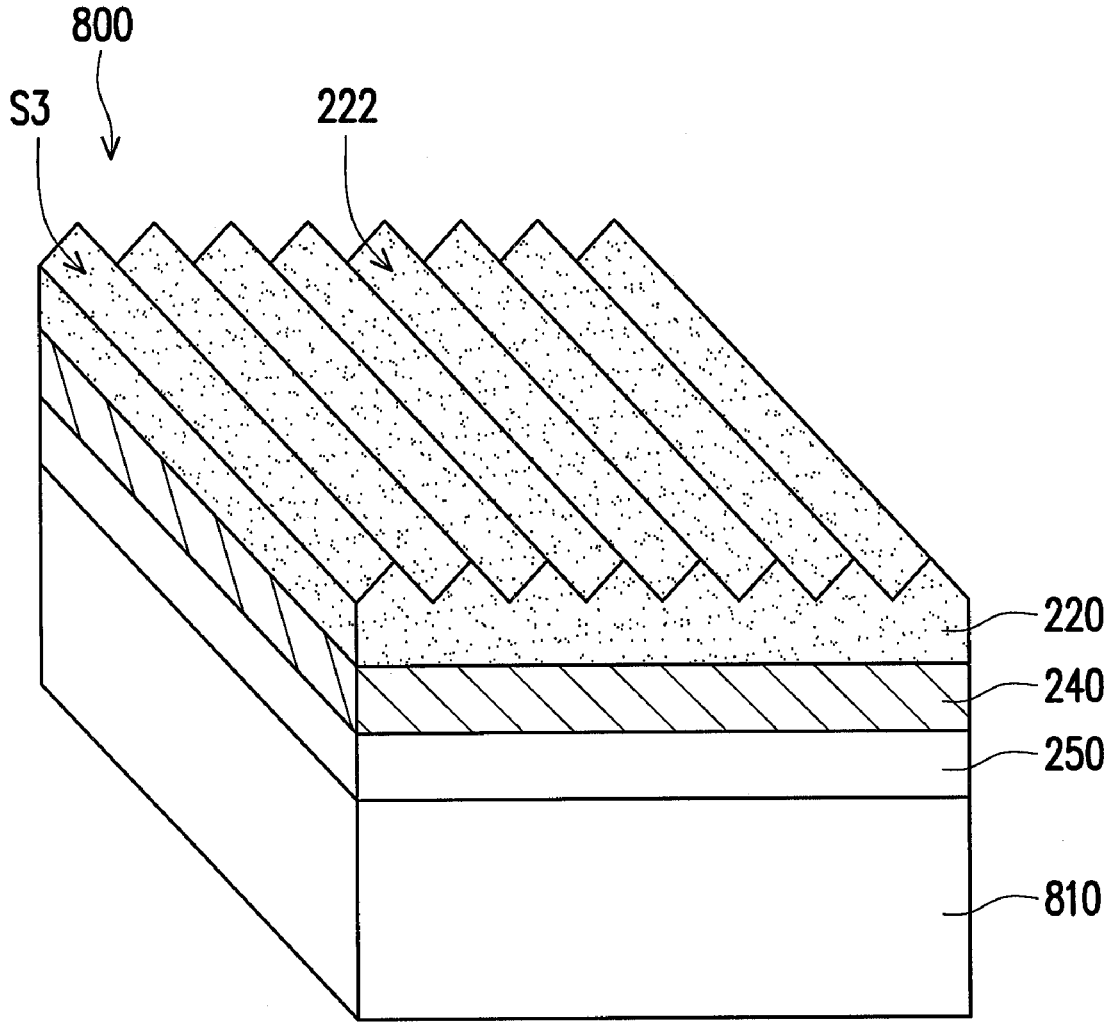
FIG. 9 is a schematic diagram illustrating the object surface structure shown in FIG. 8C.

FIGS. 8A-8C are cross-sectional diagrams schematically illustrating a thermal transfer process according to an embodiment of the present invention. FIG. 9 is a schematic diagram illustrating the three-dimensional structure shown in FIG. 8C.

Referring to FIG. 8A, the thermal transfer film 200 is provided. It should be noticed that the thermal transfer film 200 in the present embodiment is the same as the thermal transfer film 200 shown in FIG. 2, and thus, the detailed descriptions of the structure and materials are not described herein.

Referring to FIG. 8B, the thermal transfer film 200 is disposed on an object or an acceptor 810, wherein the protection layer 220 is deployed between the substrate 210 and the acceptor 810, and the decorative layer 240 is deployed between the protection layer 220 and the acceptor 810. In the present embodiment, the thermal transfer film 200 adheres to the acceptor 810 through the adhesive layer 250. In other embodiments, the adhesive layer 250 may also be formed on the acceptor 810 in advance, and the thermal transfer film 200 is then disposed on the adhesive layer 250.

Thereafter, the substrate 210 of the thermal transfer film 200 is pressurized or heated, such that the protection layer 220 adheres on the acceptor 810. Referring to FIG. 8C and FIG. 9, the substrate 210 and the release coating 230 are then lifted off, so as to expose the second three-dimensional pattern 222. At this moment, an object surface structure 800 of the present embodiment has been formed.

It should be mentioned that by having the first three-dimensional pattern 212 on the substrate 210, the protection layer 220 formed on the substrate 210 would have the second three-dimensional pattern 222 as well, and thereby the protection layer 220 with the second three-dimensional pattern 222 can be formed on the acceptor 810 after the thermal transfer. Hence, the surface of the object surface structure 800 which is formed by the thermal transfer using the thermal transfer film 200 of the present embodiment can be provided with a tactile perception of the second three-dimensional pattern 222.

The second three-dimensional pattern 222 in the present embodiment is deployed on the exterior surface of the object surface structure 800, which is distinct from a product fabricated by the conventional thermal transfer technology which has its three-dimensional pattern covered with the protection layer, as shown in FIG. 1. Accordingly, compared with the conventional product, the exterior surface of object surface structure 800 which is fabricated by the thermal transfer using the thermal transfer film 200 of the present embodiment can be possessed of a more vivid tactile perception.

The object surface structure 800 of the present embodiment includes the acceptor 810 and the protection layer 220. The protection layer 220 is disposed on the acceptor 810, and the protection layer 220 has the exposed third surface S3 far away from the acceptor 810 and the three-dimensional pattern 222 deployed on the third surface S3. The protection layer 220 can be a thermal transfer protection layer. More specifically, the protection layer 220 is formed on the acceptor 810 by means of the thermal transfer, and the protection layer 220 covers the first three-dimensional pattern 212 of the substrate 210 (as shown in FIG. 8B) before the thermal transfer, so as to form the three-dimensional pattern 222. In the present embodiment, the three-dimensional pattern 222 is, for example, a texture with a specific tactile perception, such as a brushed filament texture, a texture with particular pattern (e.g. flowers or the like decorative patterns) and the like.

In the present embodiment, the decorative layer 240 can be optionally disposed between the protection layer 220 and the acceptor 810, so as to decorate the appearance of the object surface structure 800. Besides, in the present embodiment, the adhesive layer 250 can be optionally disposed between the decorative layer 240 and the acceptor 810, so as to improve the adhesion of the decorative layer 240 and the protection layer 220.

Following examples and test results are provided to demonstrate the manufacturing method of the thermal transfer film according to an embodiment of this invention. These examples and test results are provided to prove that the thermal transfer film according to an embodiment of this invention has effects upon surface hardness, abrasion resistance and chemical resistance, but are not intended to limit the present invention.

Example I

A submount is provided, which is a polyester film with a thickness of 50 μm. A brushed filament texture with jog structure is fabricated on the submount using a roller with rough surface, so as to form a substrate with the brushed filament texture. A thermosetting acrylic release resin is then coated on the substrate with the brushed filament texture, and serves as a release layer. Afterwards, a liquid radiation curing resin layer is coated on the release layer by means of the scraper coating. The composition proportion of the aforesaid liquid radiation curing resin layer includes 60~120 units of bifunctional acrylate-based monomer, 60~120 units of bifunctional epoxy acrylate-based oligomer, 5~10 units of photoinitiator, and 50~100 units of ethyl acetate solvent.

Thereafter, the liquid resin layer is baked by a hot-air oven of 100° C. and then radiated by ultraviolet (UV) with energy of 800 mJ/cm$^2$, so as to cure the liquid resin layer and thus form a protection layer with a thickness of 8 μm. An ink layer is then printing on the protection layer. Afterwards, an adhesive layer is coated on the ink layer, such that a thermal transfer film with the protection layer is formed.

Next, the thermal transfer film is adhered to a workpiece by means of heating step or pressurizing step, and the protection layer, the ink layer and the adhesive layer are thus transferred onto the surface of the workpiece. The substrate is then lifted off, so as to achieve a finished product having a surface with protection functions and hand feeling of brushed filament.

Example II

A finished product is fabricated in a similar manner of the process illustrated in Example I, while the difference lies in that the composition proportion of the liquid resin layer is changed to 40~80 units of bifunctional acrylate-based monomer, 20~60 units of multiple functional acrylate-based monomer, 60~120 units of bifunctional polyurethane acrylate-based oligomer, 5~10 units of photoinitiator, and 50~100 units of ethyl acetate solvent.

The surface hardness, chemical resistance and abrasion resistance of the finished products obtained from said Examples I and II are evaluated under testing standards described as follows.

[Surface Hardness Test]

A pencil hardness tester under a load of 500 g is utilized for testing, wherein Mitsubishi pencils special for hardness test are adopted. The pencil was moved at an angle of 45° on the surface of the completely cured protection layer so as to test progressively from hard to soft in accordance with hardness order of the pencil from 9H to 6B. The surface is observed by naked eyes, and the final pencil hardness is determined till the pencil tip does not scratch the surface.

[Chemical Resistance Test]

Gauze is immersed into butanone, and then repeatedly rubs on the surface of the completely cured protection layer for 100 times under a load of 500 g. The surface conditions is observed by naked eyes, and determined according to the following evaluation standards: ◎ represents no damage on the surface, ○ represents slight damage, Δ represents a little damage, and x represents a lot of damage.

[Abrasion Resistance Test]

The abrasion resistance test is performed by R.C.A test method with a load of 175 g by rubbing the surface of the completely cured protection layer for 200 times. The abrasive conditions of the surface are observed by naked eyes, and determined according to the following evaluation standards: ◎ represents no abrasion on the surface, ○ represents slight abrasion, Δ represents a little abrasion, and x represents a lot of abrasion.

The test results are listed in Table 1. It can be seen that the finished products in Examples I and II have excellent performance in surface hardness, abrasion resistance and chemical resistance.

TABLE 1

| | Surface hardness | Chemical resistance | Abrasion resistance |
|---|---|---|---|
| Example I | 2H | ◎ | ◎ |
| Example II | 2H | ◎ | ◎ |

Example III

A submount is provided, which is a polyester film with a thickness of 50 μm. A desired three-dimensional pattern is printed directly on the submount, so as to form a substrate with the three-dimensional pattern. A thermosetting acrylic release resin is then coated on the three-dimensional pattern, and serves as a release layer. Afterwards, a liquid radiation curing resin layer is coated on the release layer by means of the scraper coating. The composition proportion of the aforesaid liquid radiation curing resin layer includes 60~120 units of bifunctional acrylate-based monomer, 60~120 units of bifunctional epoxy acrylate-based oligomer, 5~10 units of photoinitiator, and 50~100 units of ethyl acetate solvent.

Thereafter, the liquid resin layer is baked by a hot-air oven of 100° C. and then radiated by ultraviolet (UV) with energy of 800 mJ/cm$^2$, so as to cure the liquid resin layer and thus form a protection layer with a thickness of 8 μm. An ink layer is then printing on the protection layer, and an adhesive layer is coated on the ink layer, such that a thermal transfer film with the protection layer is formed.

Next, the thermal transfer film is adhered to a workpiece by means of heating step or pressurizing step, and the protection layer, the ink layer and the adhesive layer are thus transferred onto the surface of the workpiece. The substrate is then lifted off, so as to achieve a finished product having a surface with protection functions and hand feeling of brushed filament.

Example IV

A submount is provided, which is a polyester film with a thickness of 50 μm. The difference between this example and Example III lies in fabrication of the three-dimensional pattern. The fabrication of the three-dimensional pattern in this example is carried out by coating a resin layer on the submount, and shaping the resin layer into the desired three-dimensional pattern by imprinting, such that the substrate with the three-dimensional pattern is formed. A thermosetting acrylic release resin is then coated on the three-dimensional pattern, and serves as a release layer. Afterwards, a liquid resin layer with the same composition proportion illustrated in Example III is employed, and a finished product is fabricated in the identical process.

The surface hardness, abrasion resistance and chemical resistance of the finished products obtained from said Examples III and IV are evaluated by the testing methods mentioned above. The test results are listed in Table 2. It can be seen that the finished products in Examples III and IV have excellent performance in surface hardness, abrasion resistance and chemical resistance.

TABLE 2

| | Surface hardness | Chemical resistance | Abrasion resistance |
|---|---|---|---|
| Example III | 2H | ◎ | ◎ |
| Example IV | 2H | ◎ | ◎ |

It is noted that the foregoing illustration is described in terms of the thermal transfer film and the thermal transfer technology, which is illustrated only as an exemplary example, and should not be adopted for limiting the scope of the present invention. The thermal transfer technology is not restricted to embody the present invention based on the following embodiments. Any transfer film with a pattern protection layer that can be employed to achieve the protection layer with effects upon a three-dimensional jog tactile perception after the transfer, which certainly belongs to the spirit and scope on the present invention.

In view of the above, the transfer film of the present invention includes the protection layer, and thereby the protection layer can be formed on the surface of the finished product directly through the transfer without extra and manually spray coating the protection layer. Therefore, the fabrication time and the labor cost can be reduced. Moreover, the present invention proposes that the substrate of the transfer film has the three-dimensional pattern, and the protection layer formed on the substrate can thus have the three-dimensional pattern as well. The protection layer with the three-dimensional pattern is thus formed on the surface of the finished product after the transfer. Hence, the exterior surface of the finished product which is transferred by the transfer film of the present invention can be provided with an obvious tactile perception of the three-dimensional pattern.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A transfer film, comprising:

a substrate, having a first surface and a second surface, wherein the first surface has a first three-dimensional pattern, and the first three-dimensional pattern has at least one first protrusion portion or at least one first recess portion;

a protection layer, disposed on the substrate and having a third surface and a fourth surface, the third surface contacting the first surface and having a second three-dimensional pattern complementary to the first three-dimensional pattern, wherein the second three-dimensional pattern is formed by the third surface covering over the first three-dimensional pattern of the first surface; and a decorative layer, disposed on the protection layer, wherein the decorative layer has a pattern composed of various colors;

wherein the protection layer and the substrate are separated after a transfer so as to expose the second three-dimensional pattern.

2. The transfer film according to claim 1, wherein the substrate comprises a submount and a pattern layer formed individually, and the pattern layer disposed on the submount and covered with the protection layer has the first three-dimensional pattern.

3. The transfer film according to claim 1, wherein the protection layer comprises a thermal curing resin, a radiation curing resin or an electron beam curing resin.

4. The transfer film according to claim 1, further comprising:

a release coating, disposed between the substrate and the protection layer.

5. The transfer film according to claim 1, wherein the decorative layer comprises an ink layer or a metallic plating layer or a non-metallic coating layer.

6. The transfer film according to claim 1, further comprising:

an adhesive layer, disposed on the protection layer.

7. The transfer film according to claim 1, wherein the substrate comprises a resin film, a metal film or a paper film.

8. The transfer film according to claim 1, wherein the transfer film is suitable for thermal transfer technology.

9. The transfer film according to claim 1, wherein the second surface and the fourth surface are planar.

* * * * *